US007934479B2

(12) United States Patent
Strauss

(10) Patent No.: US 7,934,479 B2
(45) Date of Patent: May 3, 2011

(54) CAMSHAFT ADJUSTER COMPRISING A LOCKING MECHANISM

(75) Inventor: Andreas Strauss, Forchheim (DE)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 360 days.

(21) Appl. No.: 12/097,795

(22) PCT Filed: Nov. 29, 2006

(86) PCT No.: PCT/EP2006/069026
§ 371 (c)(1),
(2), (4) Date: Jun. 17, 2008

(87) PCT Pub. No.: WO2007/071528
PCT Pub. Date: Jun. 28, 2007

(65) Prior Publication Data

US 2008/0289595 A1 Nov. 27, 2008

(30) Foreign Application Priority Data

Dec. 20, 2005 (DE) ..... 10 2005 060 829

(51) Int. Cl.
*F01L 1/34* (2006.01)

(52) U.S. Cl. ..... 123/90.17; 123/90.15

(58) Field of Classification Search ..... 123/90.15, 123/90.17
See application file for complete search history.

(56) References Cited

U.S. PATENT DOCUMENTS

| | | | | |
|---|---|---|---|---|
| 5,924,395 | A * | 7/1999 | Moriya et al. | 123/90.15 |
| 6,450,137 | B2 | 9/2002 | Ogawa | |
| 6,450,138 | B1 * | 9/2002 | Kinugawa et al. | 123/90.17 |
| 6,769,386 | B2 * | 8/2004 | Shafer et al. | 123/90.17 |
| 7,261,072 | B2 * | 8/2007 | Schmitt | 123/90.15 |
| 2007/0062475 | A1 * | 3/2007 | Schmitt et al. | 123/90.17 |

FOREIGN PATENT DOCUMENTS

| | | |
|---|---|---|
| DE | 19623818 | 12/1996 |
| DE | 19918910 | 11/1999 |
| DE | 10127168 | 2/2002 |
| DE | 10147336 | 5/2002 |
| DE | 69805123 | 5/2002 |
| DE | 10253496 | 9/2003 |
| EP | 0859130 | 8/1998 |
| EP | 1164256 | 12/2001 |
| WO | 0144628 | 6/2001 |

* cited by examiner

*Primary Examiner* — Thomas E Denion
*Assistant Examiner* — Daniel A Bernstein
(74) *Attorney, Agent, or Firm* — Volpe and Koenig, P.C.

(57) ABSTRACT

A camshaft adjuster (10) for an internal combustion engine which includes a locking mechanism is provided. At least one locking element (21, 22) which can be locked in the zone of a central position (20) as well as at least one additional locking element (23, 24) that can be locked in the zone of a retarded end position (19) or an advanced end position (20) are provided such that the internal combustion engine can be selectively started from an end position (19, 20) or the central position.

3 Claims, 1 Drawing Sheet

CAMSHAFT ADJUSTER COMPRISING A LOCKING MECHANISM

BACKGROUND

The invention relates to a camshaft adjuster of an internal combustion engine, which has a locking mechanism.

In known hydraulically acting camshaft adjusters, the control times of an associated internal combustion engine are set by influencing the hydraulic relationships in control chambers, which act against each other and which act in the direction of adjustment toward an "advanced control time" and a "retarded control time." Operation of such camshaft adjusters is not problematic when the internal combustion engine provides sufficient hydraulic pressure, so that the chambers are sufficiently filled with the hydraulic medium. However, it has been shown that when the internal combustion engine is started, under some circumstances, sufficient pressure of the hydraulic medium is not provided. This has the result that the control times do not correspond to defaults or an unstable position of the camshaft adjuster is set, whereby "unstable" control times are produced. Furthermore, undesired vibrations can be generated, which can lead to the development of undesired noise, in addition to increased component wear.

For avoiding such problems, mechanical locking mechanisms are known. From DE 196 23 818 A1, a locking mechanism is known with a locking element configured as a locking pin, whose front end region has a conical configuration and which is held, in a "locked position," without clearance in a borehole with a conical longitudinal section or elliptical cross section in a cover of the camshaft adjuster. The locking pin is spring-loaded and has two hydraulic control surfaces, of which the first, end-side control surface is in hydraulic connection with a chamber of the camshaft adjuster and a second control surface formed by a shoulder of the locking pin is in hydraulic connection with another chamber acting in the opposite direction in the camshaft adjuster.

From DE 101 27 168 A1, a locking mechanism is known, in which a locking pin interacts with a step-shaped locking groove, wherein different plateaus of the step-shaped locking groove correspond to different locking positions, for example, an angle at the greatest advanced position, an intermediate position, and an angle at the greatest retarded position.

From DE 102 53 496, a locking mechanism is known, in which a first locking pin assumes a "locked position" between an "advanced" end position and a central position, while a second locking pin can assume a "locked position" between a "retarded" end position and the central position. If the oil pressure drops to zero, the first locking pin can be brought into the "locked position," while the second locking pin continues to remain in the "unlocked position." When the internal combustion engine starts up, the inner rotor is adjusted toward a "retarded" position by a dragging moment of the camshaft until the first locking pin reaches the central position. At this time point, the second locking pin also reaches the "locked position." After the engine starts successfully, the regulator increases the oil pressure in a first oil pressure line, a first working chamber, and in the region of the first locking pin. In this way, the first locking pin is unlocked, while the second locking pin is kept in pressurized contact with the second central stop. For a transition to a regulated operation, the regulator increases the pressure in the second working chamber, by which the second locking pin is also unlocked, so that the inner rotor can move freely. A corresponding locking device is also known from U.S. Pat. No. 6,450,137 B2.

From DE 199 18 910 A1, a locking mechanism is known, which has two locking pins that can be activated in the radial adjustment direction.

From the unpublished patent application of the applicant with the internal filing number of the applicant E 2004 255 with the title "Locking mechanism for a camshaft adjuster of an internal combustion engine," it is known to carry out locking in an end position of the camshaft adjuster with two locking pins, which feature different peripheral clearances and which are pressurized by different chambers of the camshaft adjuster.

SUMMARY

The invention is based on the objective of providing a locking mechanism, which guarantees

- secure locking when the internal combustion engine is turned off,
- secure unlocking according to needs,
- reliable prevention of undesired, premature unlocking, and/or
- an advantageous locking position for restart of the internal combustion engine.

The objective is met by the features of the invention. Additional configurations of the invention emerge from accordingly preferred configurations described in detail below.

According to the invention, the camshaft adjuster is locked through selective locking in the region of an "advanced" end position and a "retarded" end position. Such end-position locking has the advantage compared with central locking that by the end position, the camshaft adjuster is already fixed in one direction, so that the locking element active in the end position must block or lock only the adjustment in one adjustment direction. On the other hand, it has been shown that in selected operating situations, under some circumstances, restarting the internal combustion engine from the end positions is more advantageous than restarting from a "central position," for example, for use of the internal combustion engine in a hybrid drive.

The adjustment angle can be influenced in connection with the generation of a locking position in various (alternative or cumulative) ways:

a) Before the internal combustion engine is turned off, through suitable pressurization of the chambers of the camshaft adjuster, a targeted adjustment of the camshaft adjuster for preparing the locking can be generated. For example, the internal combustion engine can be turned off selectively in an "advanced" end position or in a "retarded" end position.

Here, for the selection of the controlled end position, the future expected operation and thus a prediction on whether the internal combustion engine should then be operated with advanced or retarded opening and closing times could then be taken into account. In this connection, a "predictor method" can be used, by which a prediction is to be made on which locking could be advantageous in a future operating state. For example, a discrimination or estimation can be performed, also for a hybrid drive, to the extent whether the internal combustion engine has been turned off only for a short time period or for a start-stop operation or if turning off the internal combustion engine for a longer time is desired. Such a predictor method could consist in that only, for example, a rotational speed of a vehicle wheel is monitored together with the occurrence of a coasting mode, from which a discrimination can be made for an approach of the motor vehicle to an intersection on one hand and a parking sequence on the other hand.

b) Furthermore, a separate adjustment device can be provided, which brings the camshaft adjuster along or into a desired position in the region of an end position after the internal combustion engine has been turned off.

c) A change in the position of the camshaft adjuster can be produced through vibrations or pulses, for which the rotor can be moved relative to the stator in both adjustment directions. For example, it can involve pulses for the pressurization of the chambers, vibrations due to the operation of the camshaft, or the like.

d) Likewise, with the first phase of the restart of the internal combustion engine, an adjustment in the direction of the locking position can occur, for which at least one of the chambers is pressurized with a low operating pressure far below the operating pressure, which can correlate to a gradual approach to a locking position.

e) When the internal combustion engine is started, friction moments act on the camshaft. Due to these mentioned friction moments, when the camshaft adjuster is driven, the camshaft lags behind, so that the camshaft adjuster can be adjusted automatically in the "retarded" direction.

The locking elements acting according to the invention in the end positions can involve single action locking elements or a double, redundant locking elements, as disclosed in the unpublished patent application of the applicant named above, wherein the geometries of the locking element and the receptacle for the locking element from this unpublished state of the art can also be transferred to the present invention.

Restarting the internal combustion engine after locking in an "advanced" or "retarded" end position can lead to a jerk-free or smoother behavior of the internal combustion engine, because the internal combustion engine is decompressed through the control times. Here, locking in an end position can be meaningful only for certain deactivation. Additional locking in a "retarded" end position can also be used as a kind of "emergency rotor," if the locking in a central position is not functional.

According to another configuration of the invention, at least one third locking element is provided, which can be locked in a third position, namely in a "central position" arranged between the "advanced" end position and the "retarded" end position. Through such a third locking position, the operating conditions to be expected after the internal combustion engine is turned off can be taken into account in an even more detailed way. On the other hand, in the most unfavorable case with deactivation of the internal combustion engine, the camshaft adjuster is in a middle position between an end position and the "central position," so that, according to the invention, the camshaft adjuster must traverse a maximum of half the distance between the end position and the "central position." Thus, also for small movements of the camshaft adjuster, one of the end positions allowing locking is reached, so that, e.g., also for small pulses, locking can be guaranteed and, under some circumstances, the camshaft adjuster reaches the locking position with reduced kinetic energy.

In one improvement of the camshaft adjuster according to the invention, the position of the camshaft adjuster is influenced when the internal combustion engine is being turned off, when an internal combustion engine is already turned off, or when the internal combustion engine is restarted by a compensation element, in particular, a spring, such as a torsion spring or a pressure spring acting in the peripheral direction. Such a compensation element can influence the force relationships on the camshaft adjuster in such a way that when the camshaft adjuster is turned off between the "advanced" end position and the "central position," this adjuster is adjusted in the direction toward the "advanced" end position. In the end position, the camshaft adjuster is then locked.

Advantageous improvements of the invention emerge from the dependent claims and the description. Additional features are to be taken from the drawings—in particular, the illustrated geometries and the relative dimensions of several components relative to each other, as well as their relative arrangement and active connection. The combination of features of different embodiments of the invention or of features of different claims deviating from the selected associations is also possible and suggested herewith. This also relates to features that are illustrated in separate figures of the drawing or that are named in their descriptions. These features can also be combined with features of different claims.

BRIEF DESCRIPTION OF THE DRAWING

Additional features of the invention emerge from the following description and the associated drawing, in which an embodiment of the invention is illustrated schematically with a camshaft adjuster in cross section.

DETAILED DESCRIPTION OF THE PREFERRED EMBODIMENT

Figure 1:
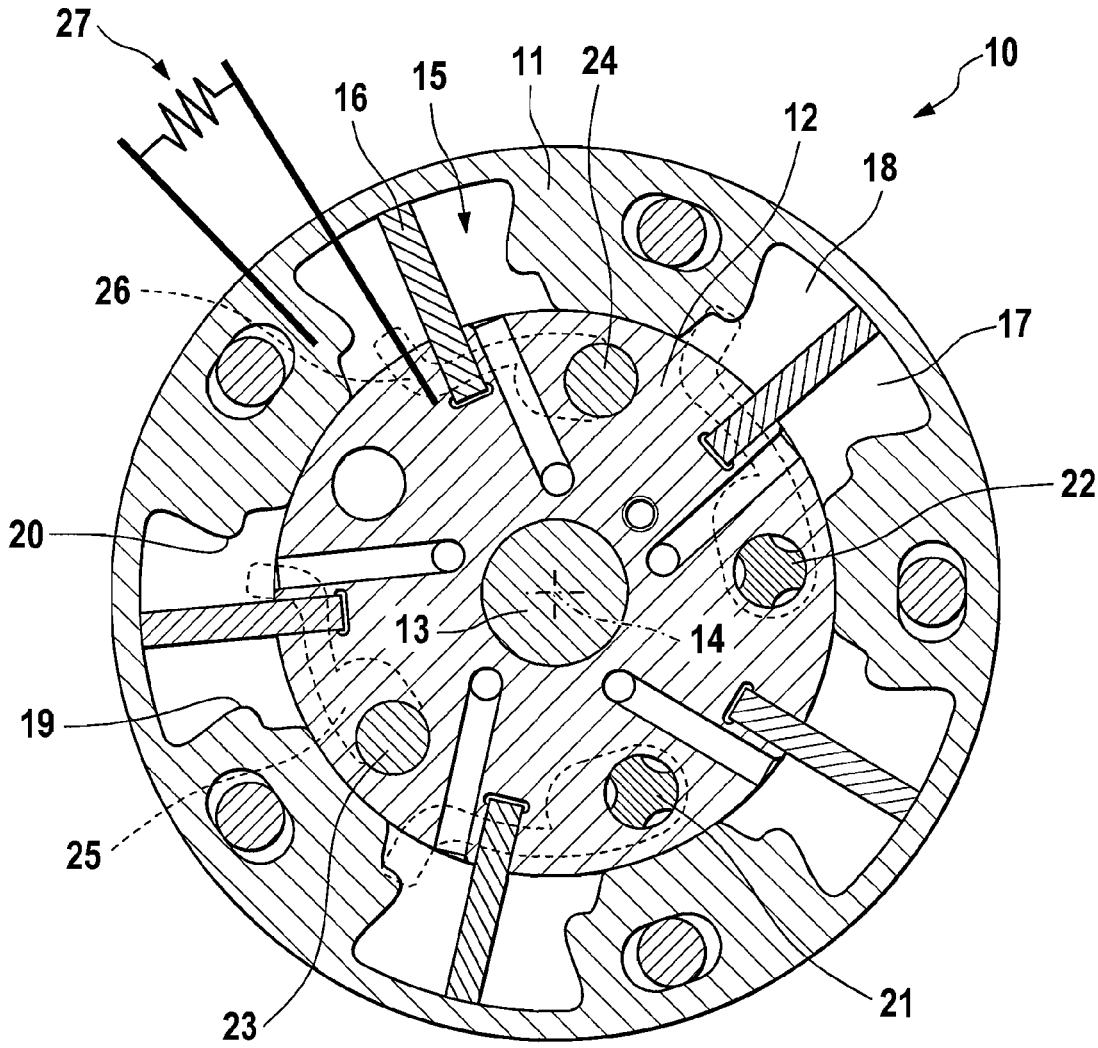

FIG. 1 shows a camshaft adjuster 10 for an internal combustion engine, in which a drive element 11, which is locked in rotation, for example, with a chain drive and which is driven by a timing chain, can be rotated in a defined way about a rotational axis 14 oriented perpendicular to the plane of the drawing relative to a driven element 12, which is locked in rotation, for example, with a camshaft 13, in the course of an adjustment movement of the camshaft adjuster 10. In the drive element 11, working spaces 15 (here five) are formed, which are bounded outward in the radial direction and also in both peripheral direction by the drive element 11 and also inward in the radial direction by a casing surface of the driven element 12. Vanes 16 of the driven element 11 divide the working spaces 15 into a chamber 17, through which the camshaft adjuster 10 is adjusted in the direction of the "retarded" end position 19, as well as a chamber 18, in which hydraulic pressurization causes an adjustment movement in the direction of the "advanced" end position 20. In the adjustment position sketched in FIG. 1, the camshaft adjuster 10 is located in a "central position," for which the vanes 16 are located approximately in the center between the "advanced" end position (20) and the "retarded" end position (19).

The camshaft adjuster 10 has a central locking mechanism with two locking elements 21, 22. The locking elements 21, 22 each lock in different areas between an end position and the central position, so that both locking elements 21, 22 are locked when the central position is reached. A detailed description of the action of such a central locking mechanism with two locking pins can be taken, for example, from publications DE 102 53 496 and U.S. Pat. No. 6,450,137 B2. The locking elements 21, 22 are designated in connection with the invention also as third locking elements.

Furthermore, the camshaft adjuster 10 has a first locking element 23, which can be transferred in the region of the "advanced" end position 20 from an "unlocked position" into a "locked position." A second locking element 24 can be transferred in the "retarded" end position 19 from the "unlocked position" into the "locked position."

The locking elements 21, 22, 23, 24 involve, in particular, a locking pin, which moves in the axial direction and which creates a positive-fit connection between the drive element 11 and the driven element 12 in the "locked position," while this positive-fit connection is released in the "unlocked position." Here, the locking pin is, in particular, spring-loaded in the direction of the "locked position" and can be brought into the "unlocked position" against the spring pressure through pressure in the region of an end face or an associated active surface of the locking pin. According to the embodiment illustrated in FIG. 1, the first locking element 23 is pressurized by a hydraulic connection 25 by the pressure in a chamber 17, while the second locking element 24 is pressurized by a hydraulic connection 27 with the pressure in a chamber 18.

For the embodiment illustrated in FIG. 1, the camshaft adjuster 10 is equipped with a compensation element 27, which influences the force relationships of the camshaft adjuster 10 in the direction of an adjustment in the direction of the "advanced" end position. If this influence is greater than a possible friction moment of the element to be adjusted when the internal combustion engine is started and if the camshaft adjuster 10 was turned off, for example, between the "advanced" end position 20 and the "central position," then the compensation element 27 can cause an adjustment of the camshaft adjuster 10 in the direction of the "advanced" end position 20.

Locking, e.g., in the "advanced" end position can also be created without the use of a compensation spring, e.g., for a V-type internal combustion engine. Here, if a control valve of one bank of the V-type internal combustion engine is blocked by a chip and adjustment is performed in the direction of the "advanced" end position, then the camshaft adjuster of the other bank can also be adjusted selectively in the "advanced" direction and locked. The same applies accordingly for an adjustment in the "retarded" direction.

For a design of the compensation spring, there are different possibilities:

The compensation spring can be designed sufficiently thick, so that for a decrease or lack of pressure, an adjustment in the direction of the end position can always take place.

On the other hand, the dragging moments in the internal combustion engine can be so large that a secure adjustment in the end position is not or not always guaranteed just by the compensation spring. Under some circumstances, the compensation spring then functions very well under normal engine operating conditions, while under extreme conditions (e.g., engine stall, cold start), the compensation spring has only an assisting effect.

LIST OF REFERENCE SYMBOLS

10 Camshaft adjuster
11 Drive element
12 Driven element
13 Camshaft
14 Rotational axis
15 Working space
16 Vane
17 "Retarded" chamber
18 "Advanced" chamber
19 "Retarded" end position
20 "Advanced" end position
21 Locking element
22 Locking element
23 First locking element
24 Second locking element
25 Connection
26 Connection
27 Compensation element

The invention claimed is:

1. Camshaft adjuster for an internal combustion engine comprising a) a drive element and a driven element, which can be moved relative to each other with an adjustment movement of the camshaft adjuster, b) a locking device with a first locking element and a second locking element, each of which can be moved from an unlocked position into a locked position, in which the locking elements at least limit a relative movement between the drive element and the driven element, c) the first locking element is in a region of an advanced end position and the second locking element is in a region of a retarded end position and both of the locking elements can be moved from the unlocked position into the locked position, and d) a spring compensation element is connected between the drive element and the driven element, wherein the spring compensation element causes an adjustment in a direction of the advanced end position, in which the first locking element then can be moved from the unlocked position into the locked position, for an operating state, in which the camshaft adjuster is located between the advanced end position and the central position.

2. Camshaft adjuster according to claim 1, wherein at least one third locking element is provided, which, in a central position of the camshaft adjuster arranged between the advanced end position and the retarded end position, can be moved from an unlocked position into a locked position.

3. Camshaft adjuster according to claim 1, wherein the first locking element is pressurized for the advanced end position by a working pressure in a chamber, which is allocated to an adjustment of the camshaft adjuster in a direction of the retarded end position, while the second locking element is pressurized for the retarded end position by a working pressure in a chamber, which is allocated to an adjustment of the camshaft adjuster in a direction of the advanced end position.

* * * * *